US008134525B2

(12) United States Patent
Yang et al.

(10) Patent No.: US 8,134,525 B2
(45) Date of Patent: Mar. 13, 2012

(54) DRIVE CIRCUIT FOR GENERATING A DELAY DRIVE SIGNAL

(75) Inventors: Chih-Hsiang Yang, Hsin-Chu (TW); Ming-Hung Tu, Hsin-Chu (TW); Ke-Chih Chang, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 876 days.

(21) Appl. No.: 11/734,311

(22) Filed: Apr. 12, 2007

(65) Prior Publication Data

US 2008/0018586 A1 Jan. 24, 2008

(30) Foreign Application Priority Data

Jul. 3, 2006 (TW) ..... 95124186 A

(51) Int. Cl.
*G09G 3/36* (2006.01)

(52) U.S. Cl. ..... 345/87; 345/94; 345/100; 345/208

(58) Field of Classification Search ..... 345/87–103, 345/208, 690

See application file for complete search history.

(56) References Cited

U.S. PATENT DOCUMENTS 5,801,674 A * 9/1998 Shimizu ..... 345/103
2003/0048249 A1* 3/2003 Sekido et al. ..... 345/98
2003/0160753 A1* 8/2003 McCartney ..... 345/99
2006/0077168 A1* 4/2006 Fujita ..... 345/100
2007/0057959 A1* 3/2007 Cho et al. ..... 345/589
2007/0146394 A1* 6/2007 Ahn ..... 345/690

OTHER PUBLICATIONS

S.H. Kim, G. Kim, S.K. Kim; "A New Driving Method to Compensate for Row Line Signal Propagation Delays in an AMLCD;" SID 04 Digest; 2004; pp. 280-283.

R. McCartney, S.H. Kim, H.W. Park, S. Kim; "A New Driving Method to Compensate for Row Line Signal Propagation Delays in an AMLCD and Analysis Using a Distributed Electrical Model;" SID 2005 Digest; 2005; pp. 128-131.

* cited by examiner

*Primary Examiner* — Amare Mengistu
*Assistant Examiner* — Jennifer Zubajlo
(74) *Attorney, Agent, or Firm* — Thomas, Kayden, Horstemeyer & Risley, LLP

(57) ABSTRACT

A drive circuit includes a drive unit coupling with data lines for receiving at least one clock signal and a first enable signal to generate a drive signal to drive data lines, and a delay unit electrically coupled with the drive unit for receiving the clock signal and the first enable signal and generating a second enable signal falling subsequent to the first enable signal in a predetermined time interval.

11 Claims, 8 Drawing Sheets

DRIVE CIRCUIT FOR GENERATING A DELAY DRIVE SIGNAL

RELATED APPLICATIONS

This application claims priority to Taiwan Application Serial Number 95124186, filed Jul. 3, 2006, which is herein incorporated by reference.

FIELD OF THE INVENTION

The present invention relates to a drive circuit, and more particularly to a liquid crystal display drive circuit.

BACKGROUND OF THE INVENTION

A typical liquid crystal display is composed of a plurality of data lines D1, D2 . . . Dy and a plurality of scan lines G1, G2, . . . , Gx. The data lines cross the scan lines. Each pair of data lines and scan line controls a pixel unit. For example, the data line D1 and the scan line G1 controls a pixel unit 100.

FIG. 1 illustrates an equivalent circuit of pixel unit 100. Each pixel unit includes a thin film transistor 101, a storage capacitor Cs and a liquid crystal capacitor Clc that is composed of a pixel electrode and a common electrode. The gate electrode of the thin film transistor 101 is connected to the scan line G1. The drain electrode of the thin film transistor 101 is connected to the data line D1. The scan signal in the scan line may turn on the thin film transistor. Then, the image signal in the data line D1 is transferred to the pixel unit 100.

Scan line drive circuit 102 may send a scan signal to the scan lines G1, G2, . . . , Gx. When one of the scan lines is selected by the scan signal, the thin film transistors connected to this scan line are turned on and the thin film transistors not connected to this scan line are remain turned off. At this time, data line drive circuit 104 may send out an image signal to the data lines D1, D2 . . . Dy to display a corresponding image. After all scan lines are driven by the scan line drive circuit 102, an image frame is displayed.

However, the scan signal is transferred through a long scan line, which delays the scan signal. FIG. 2 illustrates the scan signal delay phenomenon. In an example, the scan line G1 is used to describe the delay phenomenon. The waveform of the scan signal on the starting side of the scan line G1 is the waveform 201. When the scan signal is transferred to the remote end of the scan line G1, the waveform of the scan signal is changed to the waveform 202. Comparing the waveform 201 with the waveform 202, a serious delay phenomenon happens in the rising stage and in the falling stage. Such delay phenomenon delays the turning on the transistor connected to the remote end of the scan line G1. Therefore, the time of the transistor connected to the starting side is in an "ON" state for longer period of time than the transistor connected to the remote end. Such a time difference may shorten charging time of the storage capacitor in the remote end of the scan line. The scan signal delay phenomenon may also cause the transistors respectively connected to adjacent scan line to be turned on together.

Typically, a trigger signal 301 is used to resolve the foregoing problem as shown in the FIG. 3. The trigger signal 301 forms a time interval t between two scan signals. For example, period 302 is the period of the scan line G1. Period 303 is the period of the scan line G2. A time interval t exists between the two periods 302 and 303. The cut-off point of the thin film transistor is the point 306. Accordingly, the waveform of the scan signal in the starting side of the scan line G1 is the waveform 304. The waveform of the scan signal in the remote end of the scan line G1 is the waveform 305. Although a delay phenomenon occurs between the waveform 304 and waveform 305, the case of the transistors respectively connected to adjacent scan line being turned on together may be avoided because of the interval t. That is that after the scan line G1 is scanned, a time interval t passes before the scan line G2 is scanned. Therefore, a data 307 can be completely written into a corresponding storage capacitor.

Although a time interval t may be used to resolve the foregoing problem, the time interval has to be lengthened to ensure the storage capacitor in the remote end of a scan line is completely charged. The lengthened time interval may affect the display quality.

SUMMARY OF THE INVENTION

One object of the present invention is to provide a circuit structure that may prevent the transistors respectively connected to adjacent scan lines being turned on together Another object of the present invention is to provide a circuit structure to increase the time for charging the storage capacitor.

Still another object of the present invention is to provide a drive circuit connected in series to sequentially drive data lines.

Still another object of the present invention is to provide a drive circuit connected in series to reduce the instant current when charging the storage capacitors.

Still another object of the present invention is to provide a circuit structure to reduce the time interval between two scan signals.

Still another object of the present invention is to provide a circuit structure that may adjust the time interval between two scan signals.

According to the foregoing objects, the present invention provides a circuit structure for driving data lines of a liquid crystal display. The circuit structure comprises a drive unit coupling with data lines for receiving clock signal and a first enable signal to generate a drive signal to drive data lines, and a delay unit coupled with the drive unit to receive the clock signal and the first enable signal and generate a second enable signal falling behind the first enable signal for a time period based on a control signal.

According to one embodiment of the present invention, the delay unit comprises a control circuit for receiving a control signal to generate a plurality of switch signals, and at least one delay device coupling with the control circuit to receive a clock signal, the first enable signal and the switch signals.

According to one embodiment of the present invention, each delay device comprises a plurality of switches and a corresponding delay circuit, each delay circuit corresponds to a predetermined delay time, the switch signals switch the switches to select a delay time to output the second enable signal.

In another embodiment, the present invention provides a drive method for driving a liquid crystal panel, wherein the panel comprises a plurality of data lines and a plurality of scan lines crossing the data lines, a plurality pixel units respectively formed in the locations of the data lines crossing the scan lines, each of the pixel units includes a thin film transistor and a storage capacitor, the method comprises sequentially driving the scan lines, and sequentially driving the data lines when any one of scan lines is driven, wherein a corresponding data line is driven while a transistor in a pixel unit is turned on by a scan signal transferred in the corresponding scan line.

Accordingly, the drive signals are sequentially generated to match the scan signal delay in a scan line. Therefore, the timing to turn on the thin film transistors connected with this scan line and the timing to send out the data signal from the drive circuits are the same. Therefore, the data signal in the data line may completely charge the corresponding storage capacitor through the thin film transistor.

BRIEF DESCRIPTION OF THE DRAWINGS

The foregoing aspects and many of the attendant advantages of this invention are more readily appreciated and better understood by referencing the following detailed description, when taken in conjunction with the accompanying drawings, wherein.

DETAILED DESCRIPTION OF THE PREFERRED EMBODIMENTS

Figure 4:
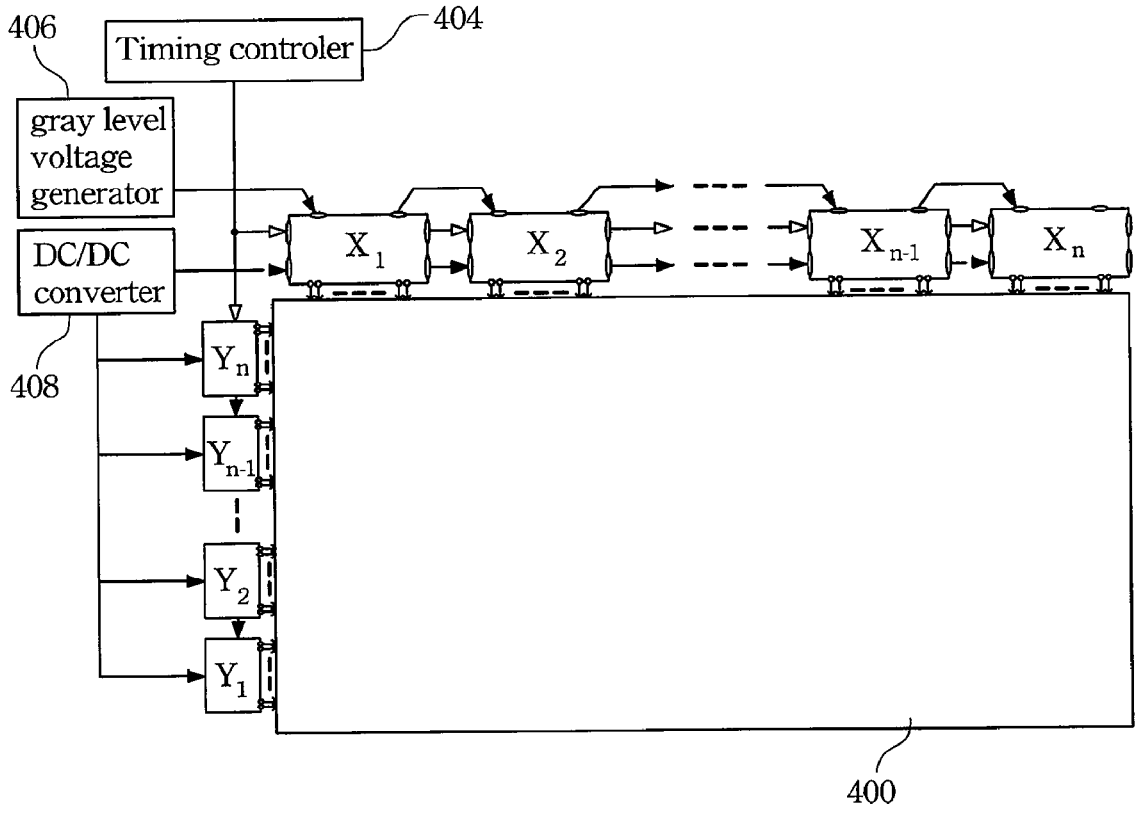
FIG. 4 illustrates a top view of a liquid crystal display according to the present invention.

FIG. 4 illustrates a top view of a liquid crystal display according to an embodiment of the present invention. The liquid crystal display comprises a panel 400 formed in a substrate (not shown in this figure), row direction drive integrated circuits Y1, Y2 . . . Yn, column direction drive integrated circuits X1, X2 . . . Xn, a timing controller 404, a gray level voltage generator 406 and a DC to DC converter 408. The row direction drive integrated circuits Y1, Y2 . . . Yn are used to generate scan signals to drive scan lines. The column direction drive integrated circuits X1, X2 . . . Xn are used to generate data signals to drive data lines. The timing controller 404 is used to generate a standard timing to the row direction drive integrated circuits Y1, Y2 . . . Yn and the column direction drive integrated circuits X1, X2 . . . Xn. The gray level voltage generator 406 is used to generate a gray level voltage. This gray level voltage is supplied to the column direction drive integrated circuits X1, X2 . . . Xn. The DC/DC converter 408 provides power to the the row direction drive integrated circuits Y1, Y2 . . . Yn, the column direction drive integrated circuits X1, X2 . . . Xn and the gray level voltage generator 406.

The power generated by the DC/DC converter 408, the gray level voltage generated by the gray level voltage generator 406 and the standard timing generated by the timing controller 404 are sequentially, cascade type, transferred to the column direction drive integrated circuits X1, X2 . . . Xn to display image in the panel 400.

Figure 5:
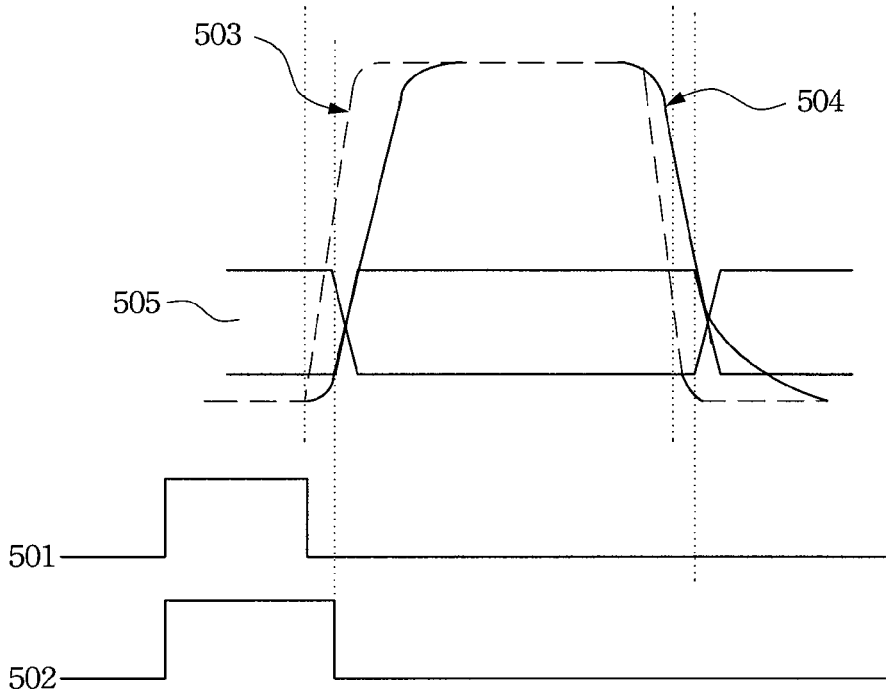
FIG. 5 illustrates a relationship diagram of the data signal and the scan signal of the present invention.

According to the present invention, a time difference can adjust among the data signals in the column direction. This time difference is used to compensate the delay of the scan signal in a scan line. Such compensation may prevent the transistors connected to adjacent scan lines are turned on together. This compensation method is described in the following. FIG. 5 illustrates a relationship diagram of the data signal and the scan signal of the present invention.

Figure 1:
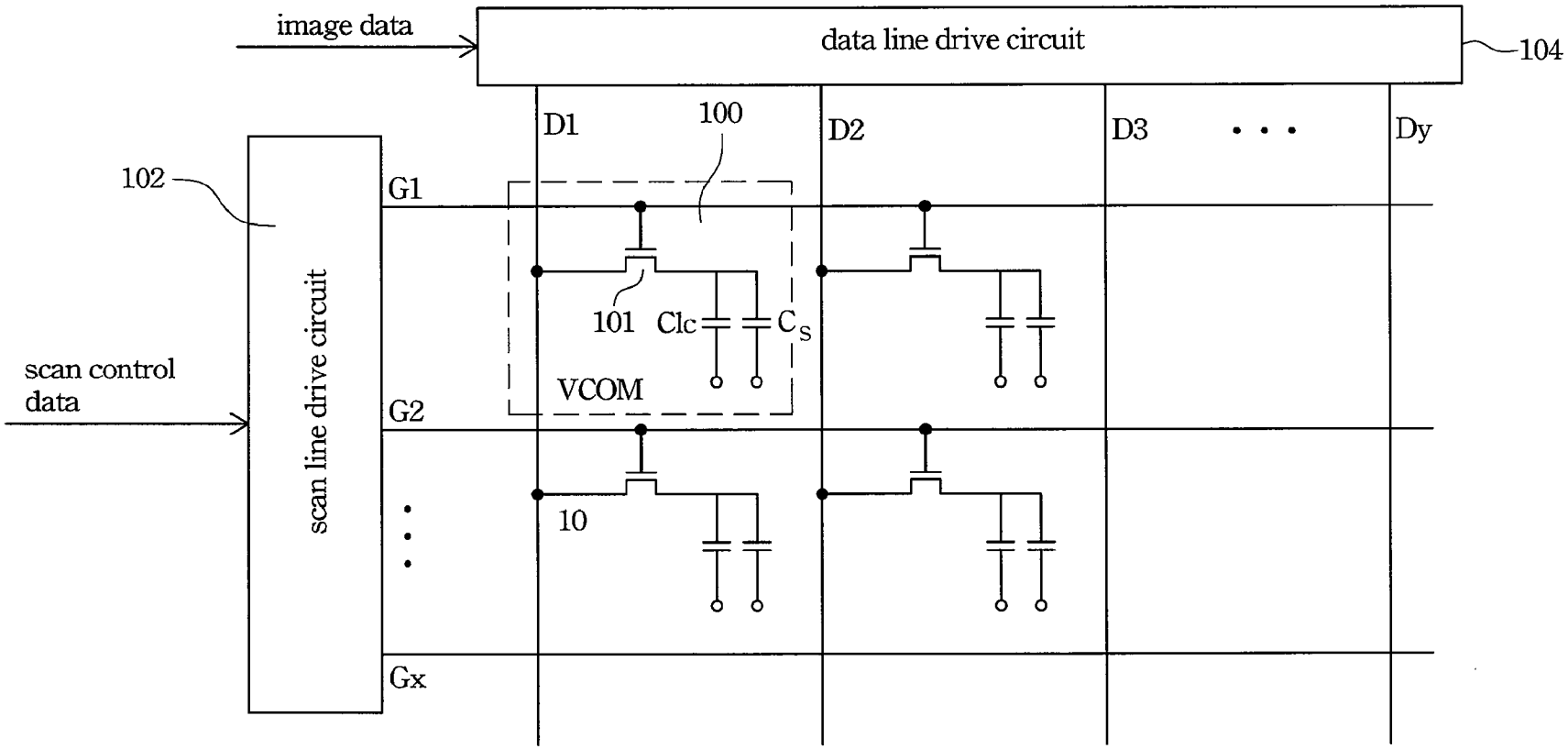
Fig. 1 (PRIOR ART)
FIG. 1 is a top view of a liquid crystal display.
Figure 2:
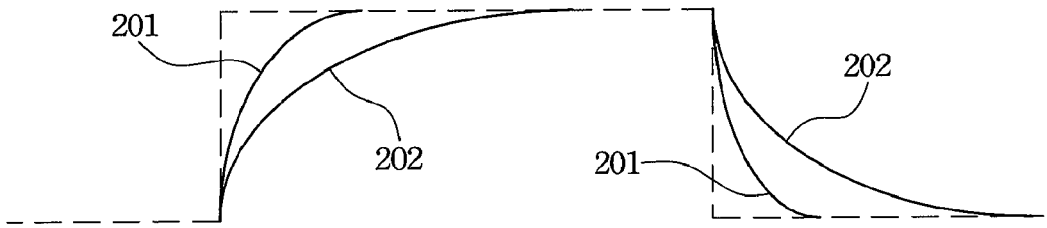
Fig. 2 (PRIOR ART)
FIG. 2 is a schematic diagram of a scan signal delay phenomenon.
Figure 3:
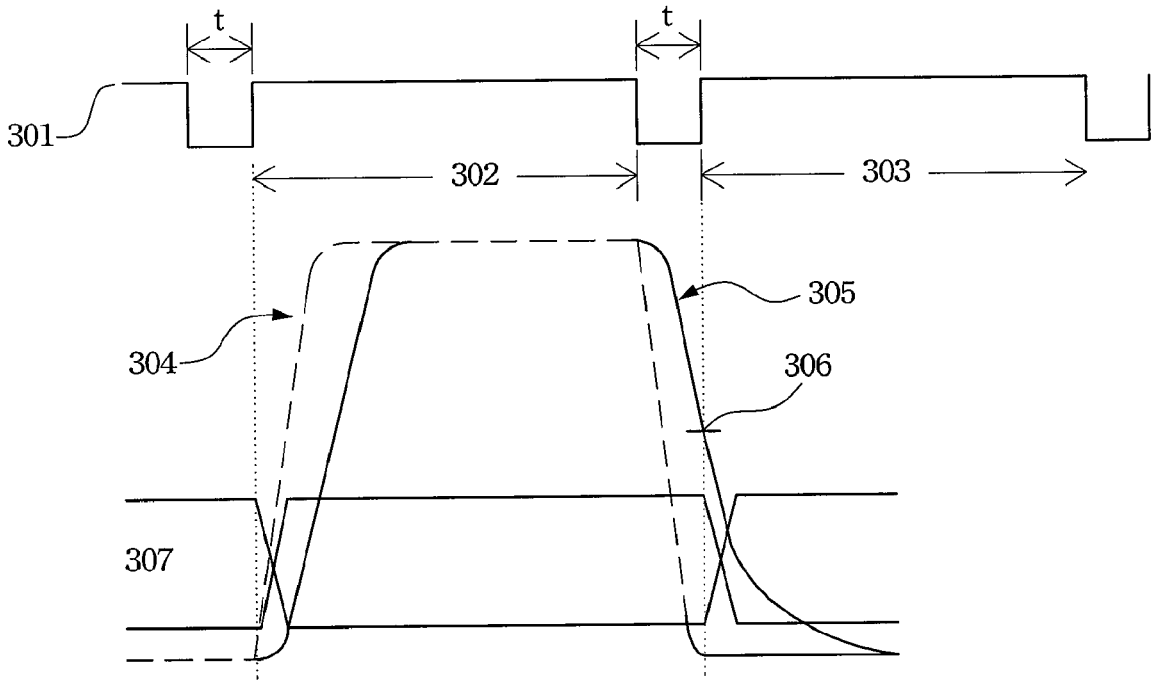
Fig. 3 (PRIOR ART)
FIG. 3 illustrates a drive waveform for resolving the scan signal delay phenomenon.

As shown in FIG. 3, a signal 301 is used to cause a time difference between two scan signals from two adjacent scan lines. Such time difference of scan signals may prevent the two transistors respectively connected to the remote end of one scan line and connected to the remote end of an adjacent scan line being turned on together.

FIG. 5 illustrates a relationship diagram between the scan signal and the data signal according to the present invention. Only two trigger signals 501 and 502 are illustrated in this figure. The two trigger signals 501 and 502 are used to trigger the first column direction drive integrated circuits X1 and the last column direction drive integrated circuits Xn respectively. Therefore, a time difference exists between the two data signals that are generated by the two drive integrated circuits respectively. It is noticed that a lot of trigger signals still exist between the two trigger signals 501 and 502 to trigger the other column direction drive integrated circuits.

Figure 6:
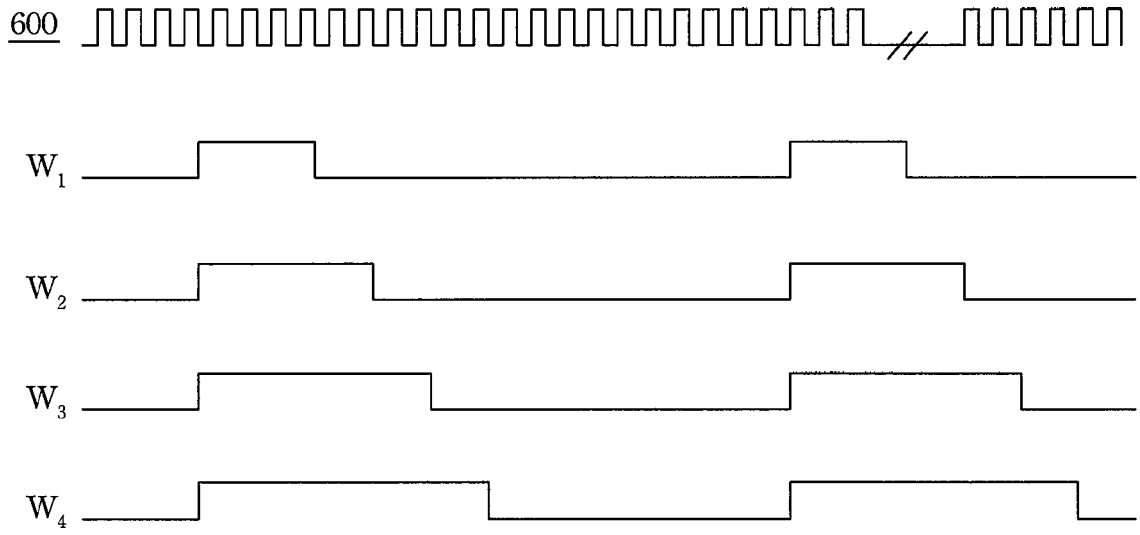
FIG. 6 illustrates the enable signal waveform generated by one of the column direction drive integrated circuits after this drive integrated circuit is triggered by a start signal from its previous stage drive integrated circuit.

FIG. 6 illustrates the enable signal waveform generated by one of the column direction drive integrated circuits after this drive integrated circuit is triggered by a enable signal from its previous stage drive integrated circuit. This enable signal is transferred to and triggers the next stage of the drive integrated circuit. Please refer to the FIG. 6 and FIG. 4 together. According to the present invention, each signal is sequentially transferred to the column direction drive integrated circuits X1, X2 . . . Xn. Therefore, the enable signals are also sequentially generated by the column direction drive integrated circuits X1, X2 . . . Xn. The waveform 600 is a standard clock signal generated by the timing controller 404. The signal W1 is a enable signal for the column direction drive integrated circuits X1 to charge or discharge the storage capacitor. After the drive integrated circuits X1 receives the enable signal W1, a enable signal W2 that falls behind the enable signal W1 is generated by the drive integrated circuits X1. The enable signal W2 is used to enable the column direction drive integrated circuits X2 to charge or discharge the storage capacitor. After the drive integrated circuits X2 receives the enable signal W2, a enable signal W3 that falls behind the enable signal W2 is generated by the drive integrated circuits X2. The enable signal W3 is used to enable the column direction drive integrated circuits X3. The rest may be deduced by analogy. The interval between any two adjacent start signals may be set by users to match the delay of the scan signals.

Referring to FIG. 5 again, the scan signal in the starting side of a scan line is the scan signal 503. The scan signal in the remote end of a scan line is scan signal 504. A time difference exists between the two scan signals 503 and 504. In this present invention, two corresponding column direction drive integrated circuits are respectively triggered based on this time difference. In an embodiment, the enable signal 501 is used to trigger the first column direction drive integrated circuits X1 for generating corresponding data signals. The column direction drive integrated circuits Xn-1 generates the enable signal 502. This enable signal 502 is used to trigger the last column direction drive integrated circuits Xn for generating the data signal 505 as shown in this FIG. 5.

According to this embodiment, the data signals generated by the column direction drive integrated circuits match the delay of the scan signal. That is the timing to turn on the thin film transistors connected with this scan line and the timing to send out the data signal from the column direction drive integrated circuits are the same. Therefore, the data signal may completely charge the storage capacitor through the corresponding thin film transistor. Such a method may resolve the problem of the storage capacitor being insufficiently charged because the connected thin film transistor is not turned on completely. On the other hand, the column direction drive integrated circuits are sequentially triggered. The timing for turning on the transistors may match the timing for triggering the corresponding column direction drive integrated circuit. Therefore, the storage capacitors may be completedly charged. In other words, it is not necessary to wait for a long interval to send the scan signal to the next scan line to prevent the transistors connected to the adjacent scan line being turned on together. Therefore, the interval between two scan signals respectively being sent to two adjacent scan lines is reduced.

On the other hand, a large instant current from a power source is happened when enable all the column direction drive integrated circuits on the panel in an instant. Such large inrush currents may cause the power source to have a large voltage drop. Such a large voltage drop may cause the voltage divider to divide mistake gray level voltage. However, the method provided by the present invention can also resolve the foregoing problem. By sequentially enable the column direction drive integrated circuits to drive the data line, it is not necessary to provide a large instant current from the power source.

Figure 7:
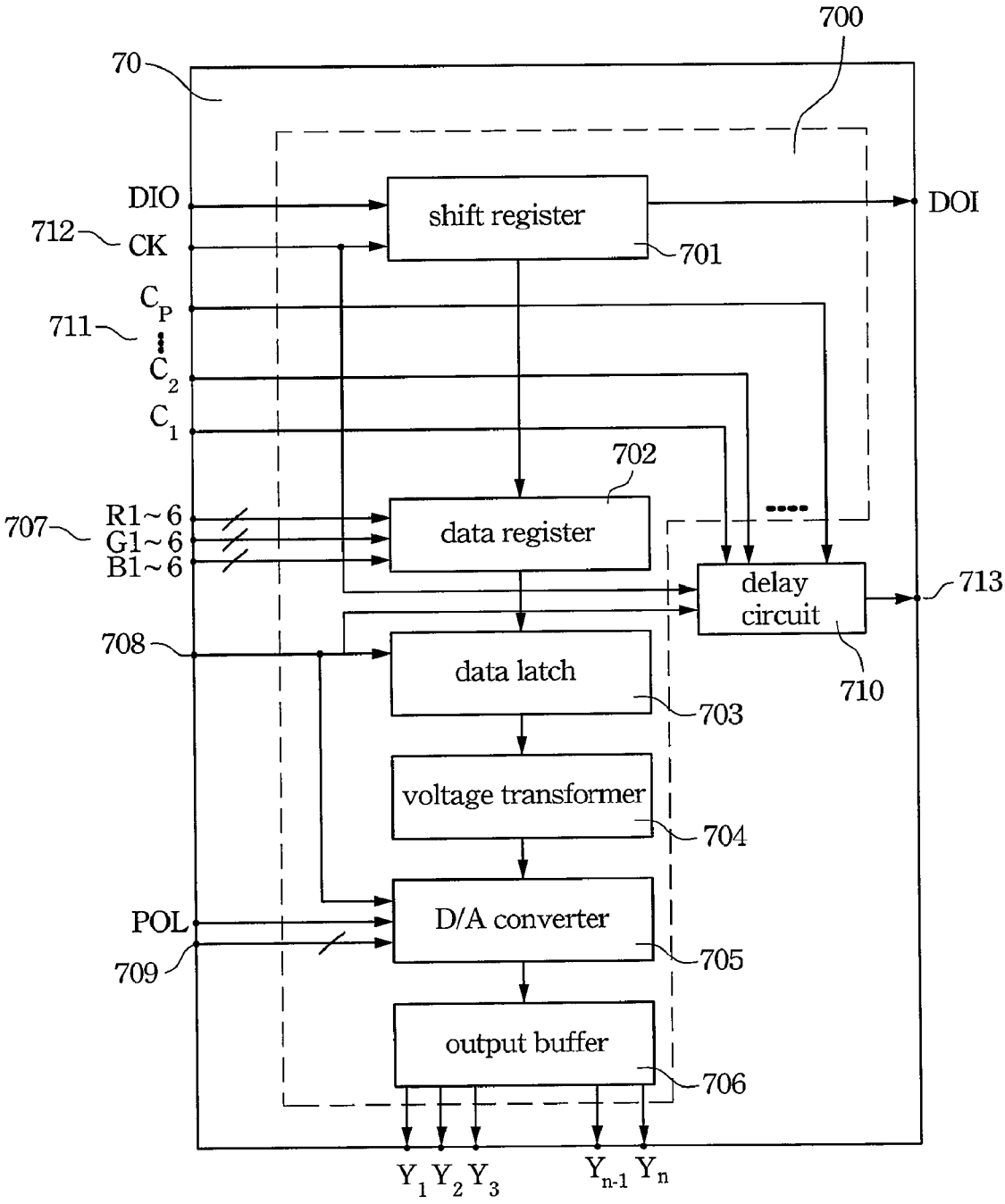
FIG. 7 illustrates the schematic circuit structure of the column direction drive integrated circuit according to the present invention.

FIG. 7 illustrates the schematic circuit structure of the column direction drive integrated circuit 70 according to the present invention. The column direction drive integrated circuit 70 includes a drive unit 700 and a delay control circuit 710. The drive unit 700 is used to output drive signals Y1, Y2 . . . Yn to the data lines connected with the column direction drive integrated circuit 70. The delay control circuit 710 is used to generate the enable signal to the next stage column direction drive integrated circuit 70. According to the present invention, the enable signal is delayed for a predetermined interval by the delay control circuit 710. Then, this delayed enable signal is transferred to and triggers the next stage column direction drive integrated circuit.

The drive unit 700 includes a shift register 701, a data register 702, a data latch 703, a voltage transformer 704, A D/A converter 705 and an output buffer 706. The digital display signal from the RGB pins 707 is sent to and stored in the data register 702. The timing for storing each pixel data is based on the clock signal. The shift register 701 controls the pixel data stored in the data register 702. When the pixel data fills up the data register 702, a drive signal from the pin 708 turn on the data latch 703. In one embodiment, if the drive unit 700 is the column direction drive integrated circuit X1, the drive signal is the drive signal W1 in FIG. 6. After the data latch 703 is turned on, the pixel data is transferred to the voltage transformer 704 to amplifier the voltage swing. Then, this pixel data is transferred to the D/A converter 705 to convert to an analog signal based on the reference voltage sent from the pin 709. Finally, the analog signal is used to drive the panel through the output buffer 706.

In a prefer embodiment of the present invention, an additional delay control circuit 710 is embedded in the column direction drive integrated circuit 70, as shown in FIG. 7, to couple with the drive unit 700. The delay control circuit 710 is used to generate a delay drive signal. According to the present invention, a control signal from the pin 711 is used to control the delay control circuit 710. This control signal may control the delay control circuit 710 to generate a delay drive signal based on the clock signal from the pin 712 and the enable signal from the pin 708. The delay enable signal is outputted from the pin 713.

Figure 8:
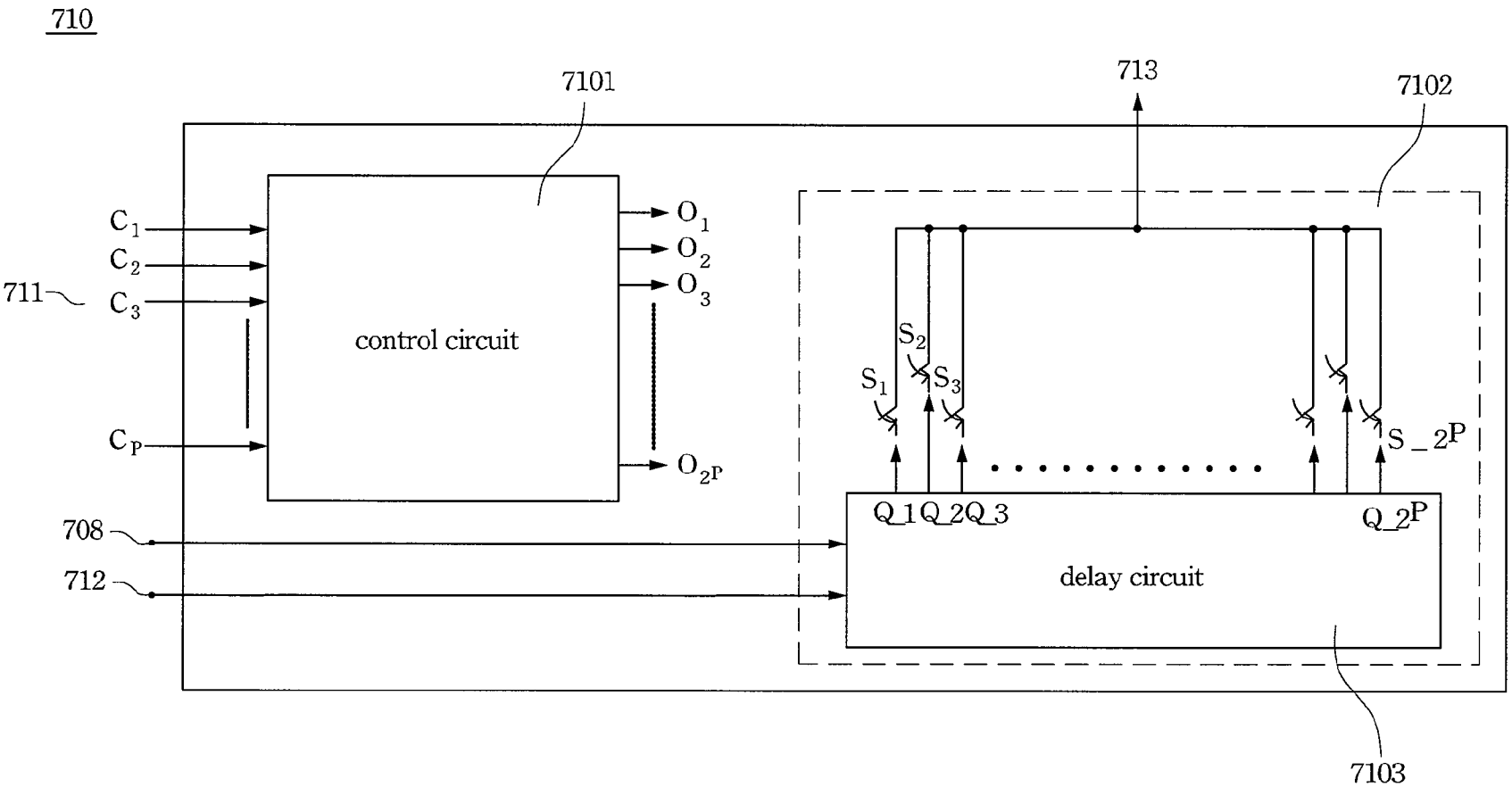
FIG. 8 is a detailed circuit diagram of the delay control circuit.

FIG. 8 is a detailed circuit diagram of the delay control circuit 710. The delay control circuit 710 includes a control circuit 7101 and a delay device 7012. The delay device 7102 includes a delay circuit 7103 and switches $S_1, S_2, S_3 \ldots S_2^P$ coupled with the delay circuit 7103. The control circuit 7101 is controlled by a control signal from the pin 711 of the column direction drive integrated circuit. This control signal may control the control circuit 7101 to output switch signals $O_1, O_2, O_3 \ldots O_2^P$ to switch the switches $S_1, S_2, S_3 \ldots S_2^P$ respectively. The delay device 7102 receives the clock signal from the pin 712 and the enable signal from the pin 708 of the column direction drive integrated circuit. The delay device 7102 generates a delay enable signal based on the clock signal, the enable signal and the switch of the switches $S_1, S_2, S_3 \ldots S_2^P$. This delay enable signal is outputted from the pin 713. The delay time of the delay enable signal is related to the clock signal. In an embodiment, the control signals from the pin 711 is formed by different voltages. For example, the number of the different voltages is P. In this case, the control circuit may generate $2^P$ switch signals to switch the switches $S_1, S_2, S_3 \ldots S_2^P$ of the delay device 7102 to set the delay time of the delay enable signal. This delay time is a multiple of the period of the clock signal. The control circuit 7101 is a multiplexer in an embodiment.

It is noticed that, in the foregoing embodiment, the setting of the delay time is based on the drive integrated circuit. In another embodiment, the setting of the delay time is also based on the signal data line or based on a plurality of data lines.

Figure 9:
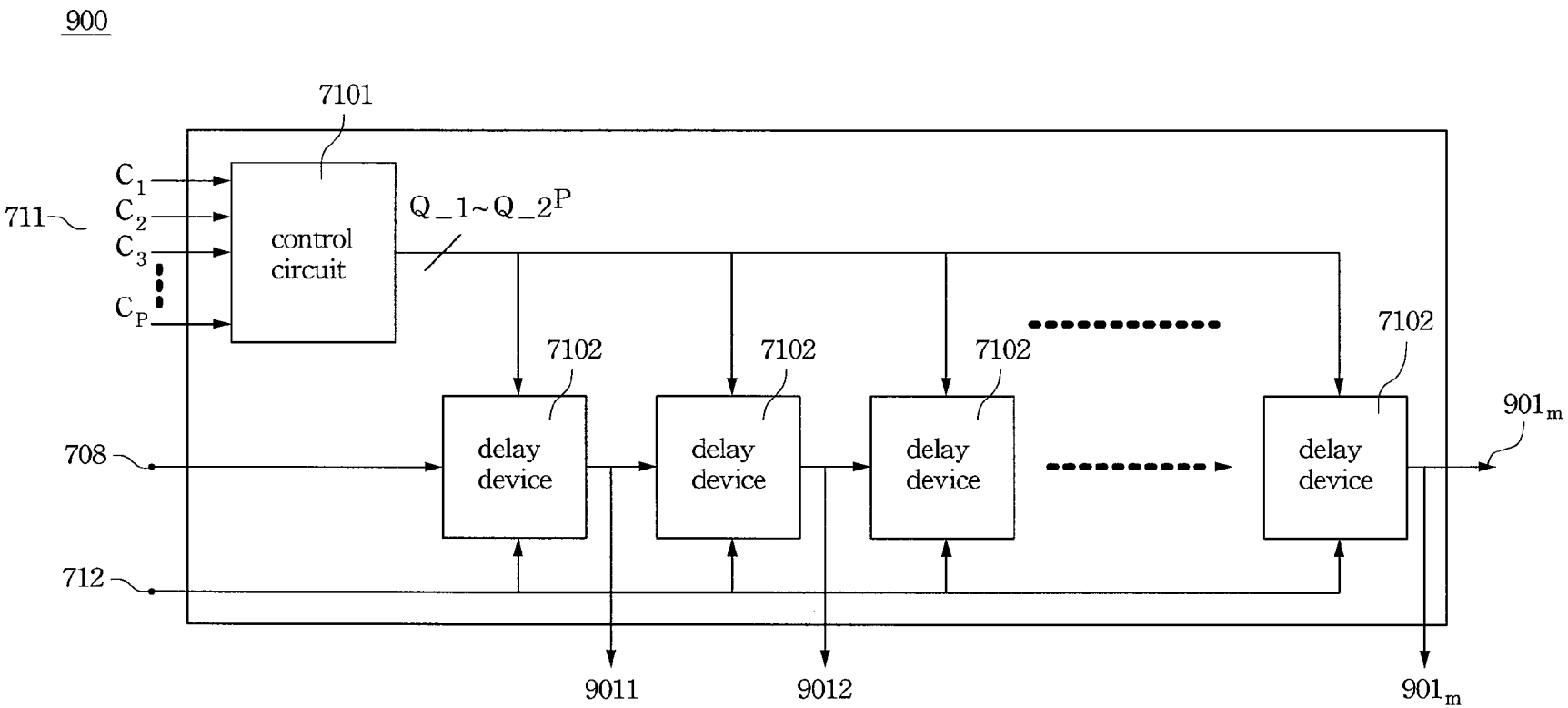
FIG. 9 illustrates a detailed circuit diagram of the delay control circuit according to another embodiment.

FIG. 9 illustrates a detailed circuit diagram of the delay control circuit 900 according to another embodiment. In this embodiment, the setting of the delay time is based on a plurality of data lines. A column direction drive integrated circuit may drive n data lines. This delay control circuit 900 has m delay devices 7102. The number m is less than the number n. Each delay device 7102 may receive the clock signal from the pin 712 of the column direction drive integrated circuit. The first delay device 7102 receives the enable signal from the pin 708. As described in the foregoing paragraph, this enable signal is delayed to form a delay enable signal 9011. This delay enable signal 9011 is outputted from the first delay device to the next delay device. The rest may be deduced by analogy to respectively generate the delay enable signal 9012, . . . 901*m* to the output buffer 706. This delay enable signal 901*m* not only transfers to the output buffer 706 but also transfers to the next stage drive integrated circuit as a enable signal.

Figure 10:
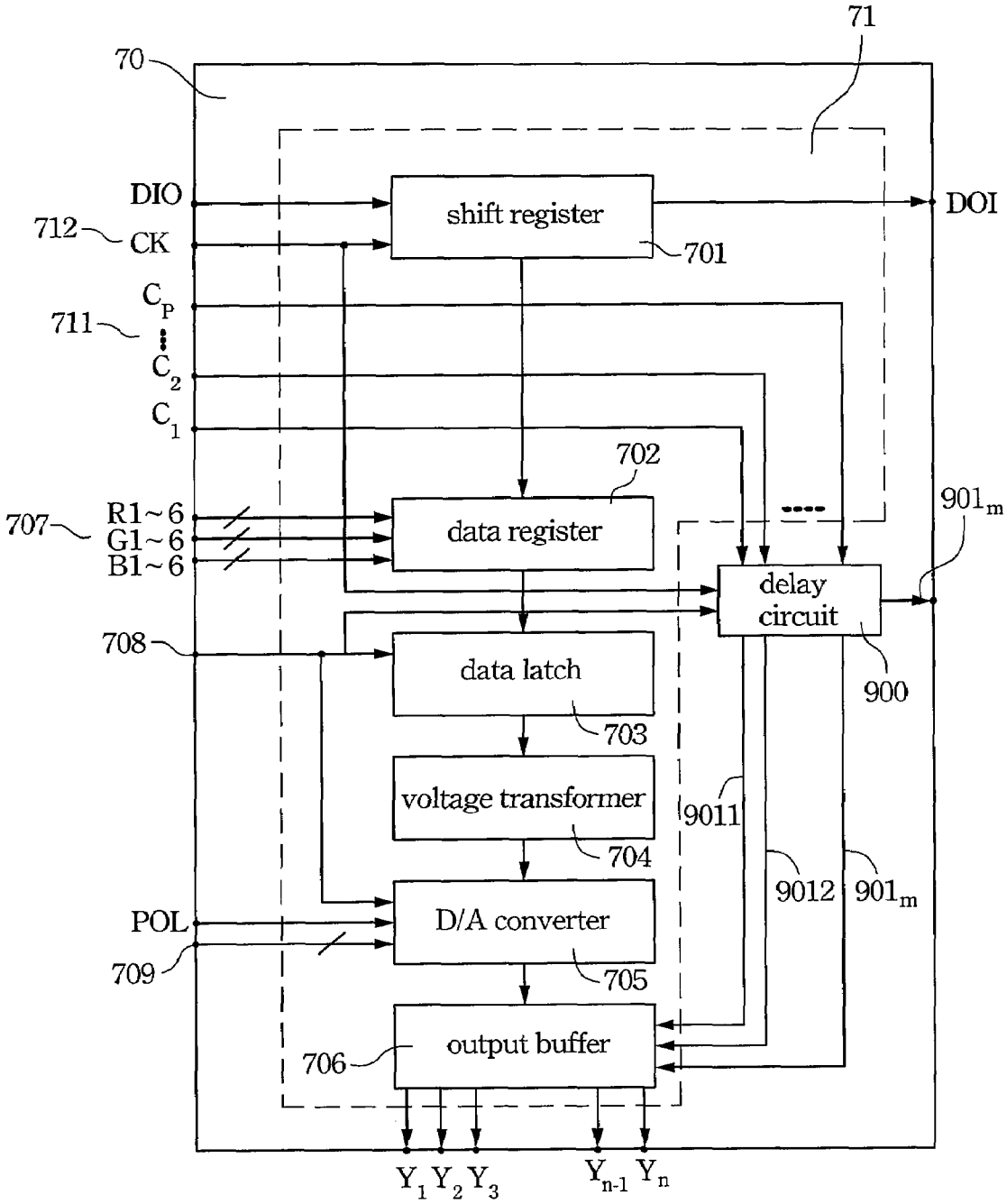
FIG. 10 illustrates a schematic diagram of this delay control circuit 900 being integrated into a drive integrated circuit.

FIG. 10 illustrates a schematic diagram of this delay control circuit 900 being integrated into a drive integrated circuit. Please refer to the FIG. 9 and FIG. 10. These enable signals 9012, . . . 901*m* generated by the delay control circuit 900 are transferred to the output buffer 706 to generate corresponding drive signals to the data lines.

Accordingly, in one embodiment of the present invention, the data lines are sequentially driven by the drive signals generated by the column direction drive integrated circuits. That is, the drive signals are sequentially generated to match the scan signal delay in a scan line. Therefore, the timing to turn on the thin film transistors connected with this scan line and the timing to send out the data signal from the column direction drive integrated circuits are the same. Therefore, the data signal in the data line may completely charge the corresponding storage capacitor through the thin film transistor. Therefore, it is not necessary to use a long interval between two scan signals to ensure the transistors respectively connected to adjacent two scan lines not being turned on together.

A control signal is issued to control the delay control circuit to determine the delay time of the output signal. The delay time is related to the clock signal.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the appended claims should be accorded to the broadest interpretation so as to encompass all such modifications and similar structures.

What is claimed is:

1. A drive circuit for driving a liquid crystal display having a plurality of data lines, comprising:

a first drive unit for receiving at least one clock signal and a first enable signal, wherein the first enable signal triggers the first drive unit to generate data signals to the data lines coupling with the first drive unit at a first time point of a first frame period;

a delay unit, electrically coupled with the first drive unit, for receiving the clock signal and the first enable signal and for generating a second enable signal in response to a control signal; and a second drive unit for receiving the second enable signal, wherein the second enable signal triggers the second drive unit to generate data signals to the data lines coupling with the second drive unit at a second time point of the first frame period, wherein the second time point is behind the first time point.

2. The drive circuit of claim 1, wherein each of the first drive unit and the second drive unit comprises:

a shift register;

a data register, electrically coupled with the shift register, for storing pixel data;

a data latch, electrically coupled with the data register, for latching the pixel data transferred from the data register;

a digital-to-analog (D/A) converter, electrically coupled with the data latch, for converting the pixel data to an analog signal; and an output buffer, electrically coupled with the D/A converter, for receiving the analog signal to drive the liquid crystal display.

3. The drive circuit of claim 1, wherein the delay unit comprises:

a control circuit for receiving the control signal to generate a plurality of switch signals; and at least one delay device, electrically coupled with the control circuit, for receiving the clock signal, the first enable signal, and the switch signals, wherein delay device comprises a plurality of switches and a delay circuit related to a predetermined delay time, and the switch signals are adopted to switch the switches to select a delay time for outputting the second enable signal.

4. The drive circuit of claim 3, wherein the control circuit comprises a multiplexer.

5. The drive circuit of claim 3, wherein the delay time is a multiple of the period of the clock signal.

6. A circuit structure for driving a liquid crystal panel having a plurality of data lines, comprising:

a plurality of drive circuits electrically coupled with the data lines, wherein the drive circuits are located in one side of the liquid crystal panel and connected in series, each drive circuit comprising:

a first drive unit, electrically coupled with the data lines, for receiving a clock signal and a first enable signal, wherein the first enable signal triggers the first drive unit to generate data signals to the data lines coupling with the first drive unit at a first time point of a first frame period;

a delay unit, electrically coupled with the first drive unit, for receiving the clock signal and the first enable signal to generate a second enable signal; and a second drive unit for receiving the second enable signal, wherein the second enable signal triggers the second drive unit to generate data signals to the data lines coupling with the second drive unit at a second time point of the first frame period, wherein the second time point is behind the first time point.

7. The circuit structure of claim 6, wherein the drive unit comprises:

a shift register;

a data register, electrically coupled with the shift register, for storing pixel data;

a data latch, electrically coupled with the data register, for latching the pixel data transferred from the data register;

a digital-to-analog (D/A) converter, electrically coupled with the data latch, for converting the pixel data to an analog signal; and an output buffer, electrically coupled with the D/A converter, for receiving the analog signal to drive the data lines.

8. The circuit structure of claim 6, wherein the delay unit comprises:

a control circuit for receiving the control signal to generate a plurality of switch signals; and at least one delay device, coupled with the control circuit, for receiving the clock signal, the first enable signal and the switch signals, wherein the delay device comprises a plurality of switches and a delay circuit related to a predetermined delay time, and the switch signals switch the switches to select a delay time for outputting the second start signal.

9. The circuit structure of claim 8, wherein the control circuit comprises a multiplexer.

10. The circuit structure of claim 8, wherein the delay time is a multiple of the period of the clock signal.

11. A method for driving a liquid crystal panel having a plurality of scan lines, a plurality of data lines, and a plurality of pixels spatially arranged in a matrix, wherein each pixel unit includes a thin film transistor having a gate electrode electrically connected to a scan line, and a source electrode electrically connected to a data line, the method comprising:

sequentially driving the scan lines; and driving the data lines, further comprising:

transferring a clock signal and a first enable signal to a first drive unit, wherein the first enable signal triggers the first drive unit to generate data signals to the data lines coupling with the first drive unit at a first time point of a first frame period;

transferring the clock signal and the first enable signal to a delay unit electrically coupled with the first drive unit to generate a second enable signal in response to a control signal; and transferring the second enable signal to a second drive unit, wherein the second enable signal triggers the second drive unit to generate data signals to the data lines coupling with the second drive unit at a second time point of the first frame period, wherein the second time point is behind the first time point.

* * * * *